US005334988A

United States Patent [19]

Murakami et al.

[11] Patent Number: 5,334,988

[45] Date of Patent: Aug. 2, 1994

[54] GLASS ANTENNA FOR AUTOMOBILE

[75] Inventors: Harunori Murakami; Yuji Baba, both of Doshomachi; Kanta Urakami, Himeji; Nobuya Niizaki, Yokohama; Hirofumi Natsume, Chiba; Masato Arisawa, Tsuchiura, all of Japan

[73] Assignees: Nippon Sheet Glass Co., Ltd.; Sumitomo Chemical Company, Ltd., both of Tokyo, Japan

[21] Appl. No.: 857,376

[22] Filed: Mar. 25, 1992

[30] Foreign Application Priority Data

Mar. 26, 1991 [JP] Japan ..... 3-086281

[51] Int. Cl.[5] ..... H01Q 1/32; H01Q 21/30

[52] U.S. Cl. ..... 343/704; 343/713

[58] Field of Search ..... 343/704, 713, 722, 850, 343/852, 853, 858, 860; H01Q 1/32, 1/38, 21/00, 21/30

[56] References Cited

U.S. PATENT DOCUMENTS

| | | | |
|---|---|---|---|
| 3,771,159 | 11/1973 | Kawaguchi et al. | 343/729 |
| 4,381,566 | 4/1983 | Kane | 455/193 |
| 4,439,771 | 3/1984 | Kume et al. | 343/704 |
| 4,491,844 | 1/1985 | Tsuchie et al. | 343/704 |
| 4,654,669 | 3/1987 | Kropielnicki et al. | 343/704 |
| 4,914,446 | 4/1990 | Lindenmeier et al. | 343/704 |
| 4,956,710 | 9/1990 | Pugel | 358/188 |
| 5,017,933 | 5/1991 | Sakurai et al. | 343/704 |
| 5,049,892 | 9/1991 | Lindenmeier et al. | 343/713 |
| 5,097,270 | 3/1992 | Lindenmeier et al. | 343/704 |

FOREIGN PATENT DOCUMENTS

| | | | |
|---|---|---|---|
| 0353515 | 2/1990 | European Pat. Off. | 343/713 |
| 0367555 | 5/1990 | European Pat. Off. | 343/802 |
| 3409979 | 9/1985 | Fed. Rep. of Germany | 343/713 |
| 3910031 | 10/1989 | Fed. Rep. of Germany | 343/713 |
| 0124041 | 10/1975 | Japan | 343/713 |
| 0033233 | 3/1977 | Japan | 343/713 |
| 0054102 | 5/1981 | Japan | 343/704 |
| 0050833 | 3/1983 | Japan | 343/713 |

OTHER PUBLICATIONS

Patent Abstracts of Japan, vol. 15, No. 295, (E-1094), Jul. 26, 1991, JP-A-3104301 (Mitsubishi Elec. Corp.), May 1, 1991.

Sheffield, Berthold, "Filter Design Simplified", Audio Engineering, Mar. 1951, pp. 13-14 & 34-36.

*Primary Examiner*—Rolf Hille

*Assistant Examiner*—Peter Toby Brown

*Attorney, Agent, or Firm*—Woodcock Washburn Kurtz Mackiewicz & Norris

[57] ABSTRACT

A glass antenna for an automobile uses a coil connected directly to a bus for defogging heaters as an FM subsidiary antenna and a T-shaped impedance matching circuit to provide a monotone change of impedance within the FM frequency band. A reverse T-shaped FM main antenna is employed in conjunction with the FM subsidiary antenna to provide a diversity system to enhance receiving sensitivity in entire directions. The T-shaped matching circuit comprises at least two varactor diodes each applied to a channel selection voltage to match the FM antenna impedance with that of the FM receiver including that of the transmission cable.

6 Claims, 5 Drawing Sheets

GLASS ANTENNA FOR AUTOMOBILE

BACKGROUND OF THE INVENTION

1. Field of the Invention

The present invention relates to a glass antenna for an automobile, and in particular, defogging heater wires on a rear window glass of the automobile are used as antenna elements.

2. Description of the Prior Art

The inventors proposed in Japanese patent application laid open No. 3-49402 (1991) a glass antenna for an automobile using defogging heater wires on a rear window of the automobile as antenna elements. FIG. 1 shows this type of the glass antenna for an automobile. In FIG. 1, a plurality of heaters or wires 3 is printed on the defogging area 2 of the rear glass 1, while an FM antenna 4 is printed above the upper portion of the uppermost heater 26.

Each heater 3 has an end connected to a power bus 5 or 6 and another end connected to a relay bus 7. The power bus 5 is connected to a power source +B having for example 12 volts through a power line 8 and a choke coil 9. The power bus 6 is connected to ground through another power line 10, another choke coil 11 and a switch 12. The choke coils 9 and 11 have high impedance characteristics against an AM frequency band to be received and are wound several turns around the toroidal core for a high frequency use. A decoupling capacitor 25 is coupled between the main power source +B and ground to reduce a power source noise.

When the heaters 3 are used for defogging the rear glass 1, the switch 12 is turned on to connect the choke coil 11 to ground. Twelve volts is then supplied through the choke coils 9 and 11 and the power lines 8 and 10 respectively to heat the upper group of the heaters 3 between the power bus 5 and the relay bus 7 and the lower group of the heaters 3 between the relay bus 7 and the power bus 6. When the heaters 3 are used as the AM antenna, an AM signal is picked up through the power line 8 or 10.

FIG. 1 also shows an impedance matching circuit 13 connected to an FM antenna provided on the rear glass 1 as proposed in Japanese utility model application laid open No. 2-64219 (1990), entitled The impedance matching circuit 13 comprises a reactance circuit consisting of a coil and a variable capacitance or varactor diode so as to perform an impedance matching for a radio receiver viewed from the FM antenna through a cable 27 at a random frequency by using a frequency selective signal applied from the radio receiver through the cable 27.

The sensitivity of the FM antenna 4 as shown in FIG. 1 has a bidirectional characteristic. Particularly, the direction perpendicular to that of the maximum sensitivity has a poor sensitivity. The FM antenna 4 provided along the rear window is not suitable for a vehicle antenna since a direction of electric wave with respect to the antenna is often changed over 360 degrees while driving the automobile.

It is therefore necessary to construct a diversity antenna system by using FM main and subsidiary antennas to complement their directivities. The FM main antenna comprises the FM antenna 4 while the FM subsidiary antenna comprises the AM antenna in the defogging area 2 as shown in FIG. 1. However, the resistance (real) and reactance (imaginary) components of the antenna impedance at the feeding point adjacent to the upper portion on the power bus 5 of FIG. 1 change within the FM frequency band as shown by curves A in FIGS. 2 and 3 respectively when the heaters 3 are used as the FM subsidiary antenna. They show parallel resonance characteristics each having a peak within the FM frequency band. When such an FM antenna with the peak impedance characteristic is employed with the conventional dynamic impedance matching circuit to match the impedance of the transmission cable 27, the matching circuit can not trace at respective frequency the non-monotonic impedance which non-monotonically change with respect to the frequency due to a saw-toothed voltage sweep upon a channel selection of a FM program. The mean gain value of the antenna system with the impedance matching circuit is lower than that of the antenna system without the impedance matching circuit over the FM frequency band. Since the choke coils 9 and 11 generally have an inductance of 600 to 1300 micro-henries and a stray capacitance of several to several ten picofarads, they have sufficiently high impedance to prevent the AM signal induced by the heaters from going through the body of the automobile in the AM band However, since they have low impedance in the FM band, they result in the FM signal going through the body. Therefore, since a sufficient antenna voltage in an open state can not be obtained, the gain of the antenna system is lowered.

SUMMARY OF THE INVENTION

It is a primary object of the present invention to provide a glass antenna having a monotonic change or simply increased or decreased resistance and reactance components in the antenna impedance over different frequencies.

It is another object of the invention to provide a heater antenna having high open voltage at least within the FM frequency range.

A glass antenna for an automobile according to the present invention comprises a main antenna having a reverse T-shape, a subsidiary antenna consisting of defogging heaters, and a coil directly connected to a power bus of the heaters to supply energy to said heaters through the coil and the power bus.

The above, and other objects, features and advantages of the invention will be apparent in the following detailed description of illustrative embodiments of the accompanying drawings.

DETAILED DESCRIPTION OF A PREFERRED EMBODIMENT

Figure 4:
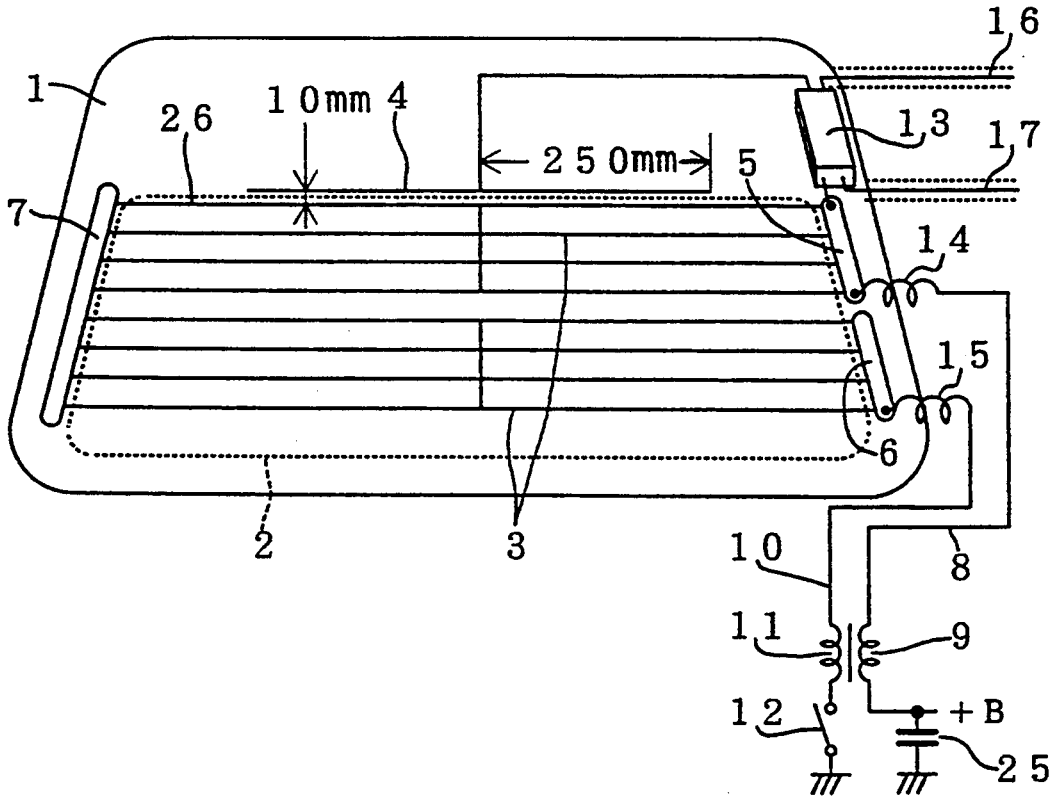
FIG. 4 shows a first embodiment of the rear glass antenna for an automobile applied to the present invention.

FIG. 4 shows a first embodiment of the glass antenna for an automobile according to the present invention. The same numerals are denoted for parts corresponding to those of FIG. 1. In FIG. 4, a plurality of heaters 3 each serving as an AM and FM antenna are printed or coated on a defogging area 2 of a rear glass 1. A reverse T-shaped FM main antenna 4 is also printed or coated on a upper portion above the upper heater 26.

Figure 5:
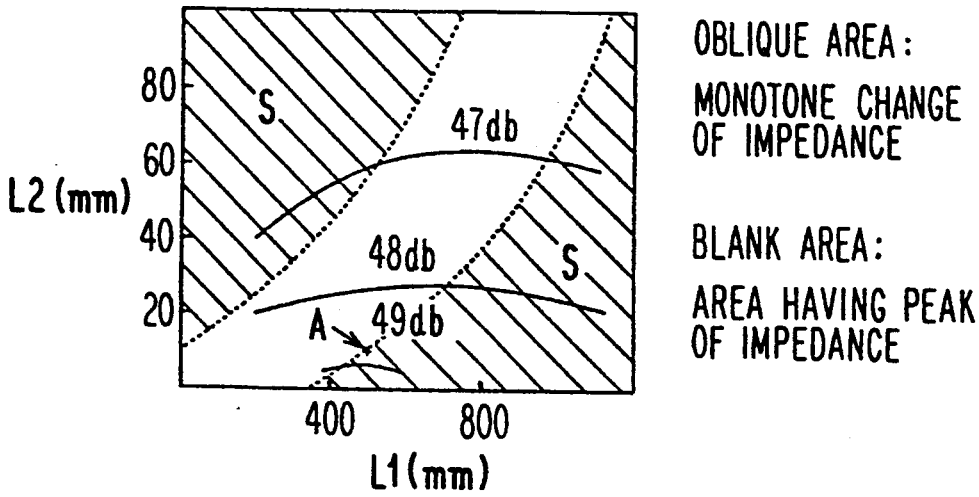
FIG. 5 is a graph showing size, sensitivity and impedance characteristics of the FM main antenna of FIG. 4.
Figure 6:
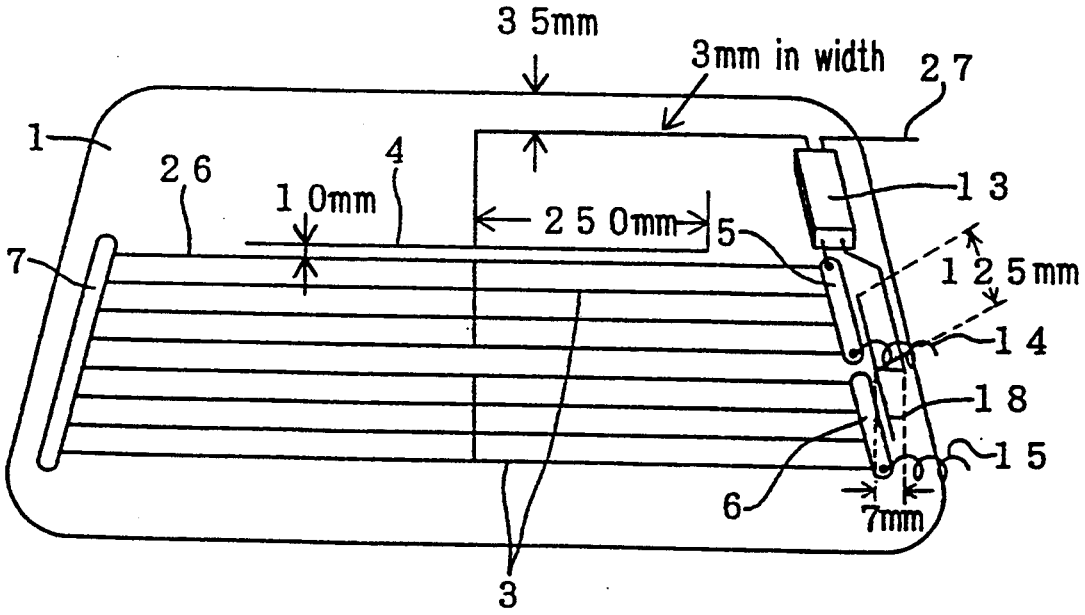
FIG. 6 shows a second embodiment of the rear glass antenna for the automobile according to the present invention.

The reverse T-shaped FM main antenna 4 has a bidirectional characteristic which has the highest receiving sensitivity for a direction perpendicular to a drive direction of an automobile. The impedance of the FM main antenna 4 changes monotonically or with the parallel resonance characteristic within the FM frequency as a function of the distance between a horizontal element of the antenna and the heater and the length of the horizontal element. Assuming that the length of the horizontal element of the FM main antenna 4, that is parallel to the heater 26 is L1 and the distance between the parallel antenna portion and the closest element of the heater 26 is L2, the area where the antenna impedance simply or monotonically changes from 76 to 90 megahertz is illustrated by oblique regions S as shown in FIG. 5. FIG. 5 also shows the relation among the pattern size in the FM main antenna 4, a gain of the antenna system in which the antenna 4 is directly connected to a transmission cable to supply a signal to a radio receiver and the antenna impedance thereof. Considering the bandwidth of matching gain and the peak value of the system gain upon applying the dynamic impedance matching circuit 13 to the FM antenna 4, the dimension at point A of FIG. 5 was found to be superior. In one embodiment, the L1 is predetermined to be 500 millimeters while the L2 is predetermined to be 10 millimeters as shown in FIG. 6.

Figure 1:
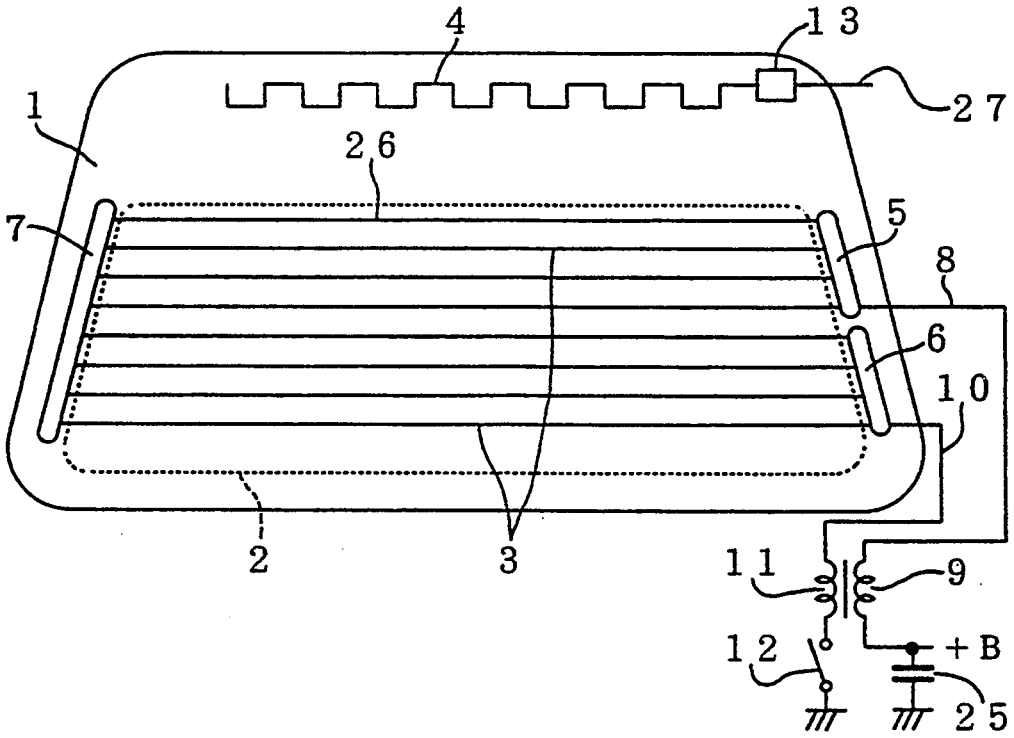
Fig. 1 PRIOR ART
FIG. 1 shows a schematic view of a rear glass of a conventional automobile.

The heaters 3 serving as both the AM and FM subsidiary antennas have the highest receiving sensitivity along an axis of a vehicle and are identical to that of the FIG. 1 except for comprising coils 14 and 15. The coil 14 has an end connected directly to the power bus 5 and another end connected directly to the power line 8. The coil 15 also has an end connected directly to the power bus 6 and another end connected to the power line 10. These coils 14 and 15 may be 0.5 to 2.5 microhenry respectively.

The signals induced by the FM main antenna 4 and the AM/FM subsidiary antenna 3 are supplied to a dynamic impedance matching circuit 13 provided on the glass surface. The dynamic impedance matching circuit 13 has a function of impedance matching between the input impedance of the radio receiver viewed through the transmission cable 16 and the FM antenna impedance at random frequencies within the FM frequency band by changing the capacitance of the varactor diode in the circuit based on the frequency selection signal from the radio receiver through the cable. The dynamic impedance matching circuit 13 also has another function of controlling the resonance between the AM antenna and the radio receiver including the transmission cable 17 within the FM frequency band.

Figure 2:
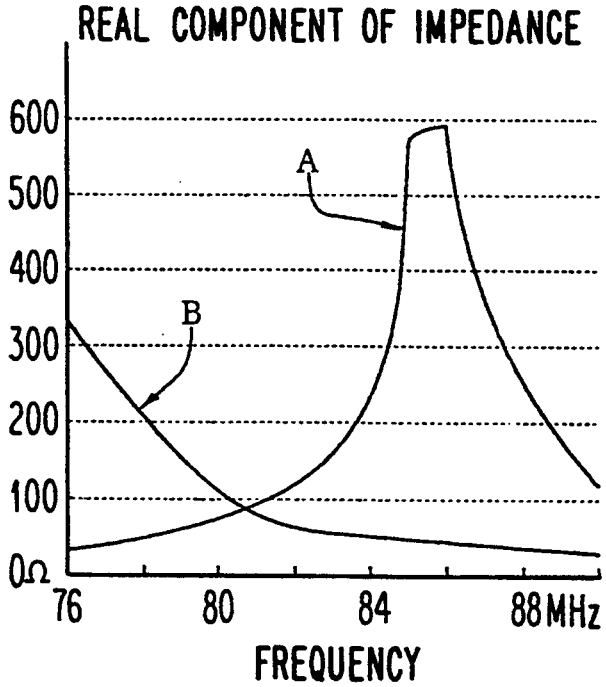
FIG. 2 is a graph indicating the frequency characteristics of the real or resistance component of the antenna impedance of conventional heaters and the heaters according to the present invention.
Figure 3:
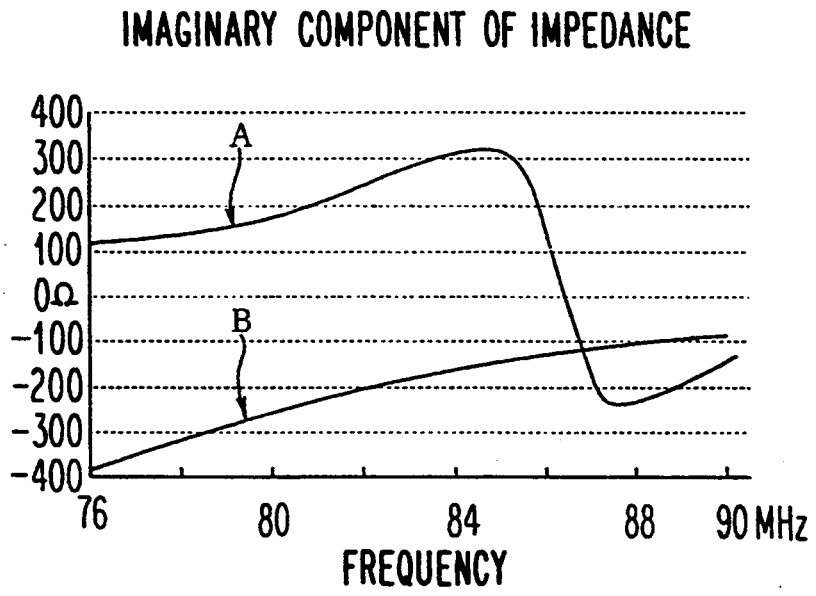
FIG. 3 is a graph indicating the frequency characteristics of the imaginary or reactance component of the antenna impedance of conventional heaters and the heaters according to the present invention.

In FIGS. 2 and 3, the curvature A represents a frequency change in resistance and reactance components of the impedance of the conventional antenna consisting of the heaters 3 without using the coils 14 and 15. The curvature B represents frequency change in resistance and reactance components of the impedance of the present antenna consisting of the heaters 3 with the coils 14 and 15 (1.6 microhenries. As apparent from the drawings, it is noted that the conventional antenna impedance having non-monotonic change including peak or a parallel resonant point within the FM frequency band of 76 to 90 MHz, is changed to have a simple or monotonic characteristic only by inserting the coils 14 and 15 respectively between the buses 5 and 6, and the power lines 8 and 10.

By using the coils 14 and 15, the impedance of the FM subsidiary antenna 3 has the monotone change as shown in FIGS. 2 and 3. The system gain is enhanced due to the substantially complete impedance matching between the subsidiary antenna and the radio receiver viewed through the transmission cable 16 at the random frequency within the FM frequency band. Because the dynamic impedance matching circuit has an adequate frequency tracking characteristic, a certain voltage of the saw-toothed sweep corresponds to one of the FM-band frequencies. Further, the impedance of the coils 14 and 15 is sufficiently high to block electric waves of the FM band. The FM signal leaks to the automobile body when the stray capacitance of the choke coils 9 and 11 is reduced. The system gain by the subsidiary antenna is further enhanced due to an increased open voltage of the subsidiary antenna.

The following table 1 represents measurements A of the relative system gain having the transmission cable directly connected to the defogging heater antenna 3 without the coils 14 and 15. Table 1 also shows measurements B of the relative system gain having the transmission cable directly connected to the present defogging heater antenna 3 with the coils 14 and 15.

TABLE 1

| | Relative system gains (db) | | | | | | | |
|---|---|---|---|---|---|---|---|---|
| Frequency | 76 | 78 | 80 | 82 | 84 | 86 | 88 | 90 |
| A | 46.4 | 45.2 | 44.4 | 41.2 | 44.2 | 45.4 | 46.0 | 46.0 |
| B | 47.2 | 46.4 | 47.1 | 46.3 | 48.3 | 49.3 | 50.2 | 50.7 |
| B-A | 0.8 | 1.2 | 2.7 | 5.1 | 4.1 | 3.9 | 4.2 | 4.7 |

Frequency unit (MHz), Gain unit (db = decibel)

As seen in the table 1, the gain of the basic system having the transmission cable directly connected to the defogging heater antenna 3 is increased over the entire FM frequency band by using the coils 14 and 15. Particularly, a great increase is seen in the higher frequency portion of the FM frequency band.

The following Table 2 represents calculation values A of the system gain improvement by the dynamic impedance matching circuit 13 connected between the transmission cable and the defogging heater antenna 3 without the coils 14 and 15. Table 2 also shows calculation values B of the system gain improvement by the dynamic impedance matching circuit 13 connected between the transmission cable and the defogging heater antenna 3 with the coils 14 and 15.

TABLE 2

| Increase of the system gains by the dynamic impedance matching circuit | | | | | | | | |
|---|---|---|---|---|---|---|---|---|
| Frequency | 76 | 78 | 80 | 82 | 84 | 86 | 88 | 90 |
| A | 2.6 | 2.2 | 1.1 | −0.1 | −1.4 | −0.2 | 0.5 | 1.1 |
| B | 4.6 | 4.1 | 3.6 | 2.5 | 1.7 | 1.7 | 1.3 | 1.0 |
| Frequency unit (MHz), Gain unit (db = decibel) | | | | | | | | |

As seen from the table 2, the gain of the system without the coils 14 and 15 is reduced compared to that with the matching circuit 13 at some FM-band frequencies because a frequency tracking operation by the dynamic impedance matching circuit 13 is not appropriately performed. The increase in the system gain by the combination of the matching circuit 13 and coils 14 and 15 is higher than that by the matching circuit 13 alone.

As described above in tables 1 and 2, the gain of the present system comprising the defogging heater antenna 3 having the coils 14 and 15 with the dynamic impedance matching circuit 13 which is connected between the antenna 3 and the transmission cable, is higher than that of the defogging heater antenna 3 without the coils 14 and 15 over the entire FM-band frequency.

FIG. 6 shows a second embodiment of the rear glass antenna for the automobile. This glass antenna is different from that of FIG. 4 in picking up the FM subsidiary signal. The AM signal is supplied to the matching circuit 13 through the power bus 5 while the FM subsidiary signal is supplied to the matching circuit 13 through a lateral T-shaped FM subsidiary antenna 18 which is arranged parallel to the power buses 5 and 6 to provide a capacitance coupling. The subsidiary antenna 18 is placed approximately 5 millimeters away from the power buses 5 and 6 and has an effective length of approximately 125 millimeters or total approximate length of 250 millimeters. A feeder line to the matching circuit 13 is separated from the center of the lateral T-pattern 18 by approximately 7 millimeters to prevent the interference therebetween. The FM main antenna 4 is connected to the matching circuit 13 through another feeder line having 3 millimeter width. Another feeder line is disposed so that its parallel portion to the FM main antenna 4 is far from the antenna 4 to prevent the interference therebetween. The distance between the feeder line and an upper edge of the rear glass 1 is, for example, 35 millimeters.

Figure 7:
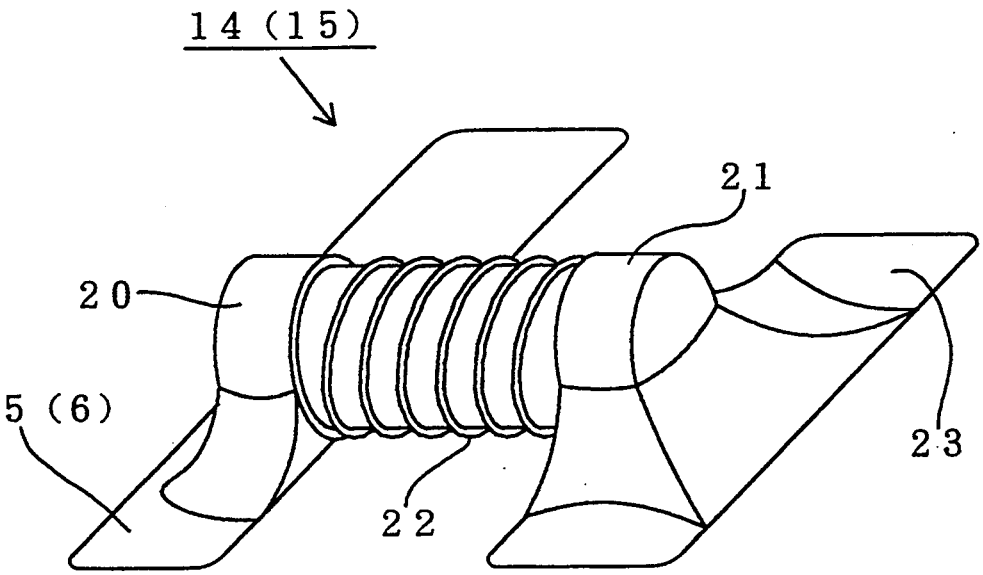
FIG. 7 is a perspective view of an embodiment of the coil according to the present invention.

FIG. 7 shows the coil 14 or 15 which is suitable for use in the present invention and surface-mounted on the rear glass 1. The coil 14 may be a wireless component comprising a cylindrical insulating ceramic and two metal caps 20 and 21 each covering one side of the ceramic and wire 22 such as an enamel line which is wound on the cylindrical surface of the ceramic. The ends of the wire 22 are connected to the metal caps 20 and 21 by solder or weld. The end of the coil 14 or 15 which may be the cap 20 is connected to the power bus 5 or 6 by soldering while another end or the cap 21 is soldered directly to a land 23 which is printed or coated on the rear glass 1. The land 23 is connected to the power line 8 or 10 to provide the current to the heaters 3.

A toroidal coil wound around a toroidal core for several turns can be employed instead of the wireless coil. In this case, ends of the coil are respectively soldered onto the power bus 5 or 6 and the land 23.

Figure 8:
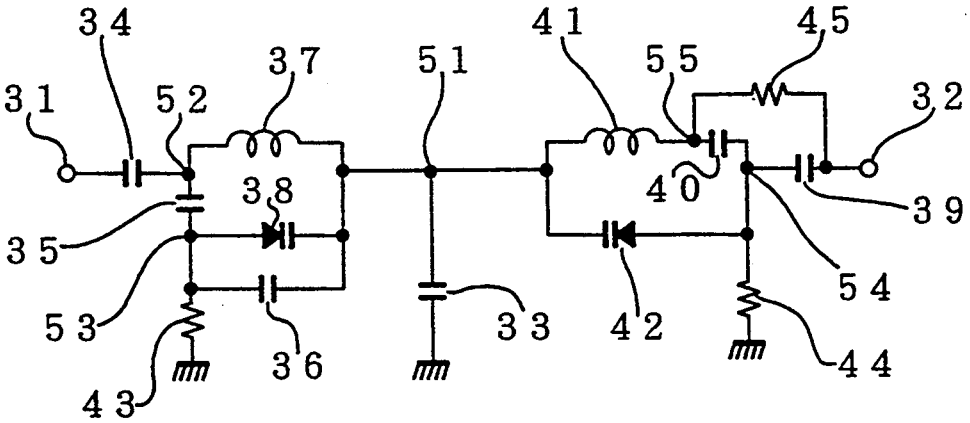
FIG. 8 is a circuit diagram showing an embodiment of the dynamic impedance matching circuit.

FIG. 8 shows an embodiment of the dynamic matching circuit 13 which makes it T-type. An input terminal 31 of FIG. 8 is connected to the glass antenna 3 or 4 of FIGS. 4 and 6 while an output terminal 32 of FIG. 8 is connected to the transmission cable 16 or 27 of FIG. 4 and 6. The matching circuit 13 comprises a central capacitor 33 connected between the first node 51 and ground. The central capacitor 33 is also connected between the first and second variable reactance circuits (LC resonators) as shown in a left and right branch of FIG. 8. The first variable reactance circuit consists of a coupling capacitor 34 connected between the input terminal 31 and a second node 52, a DC cutoff capacitor 35 connected between the second node 52 and a third node 53, a capacitor 36 and a varactor diode 38 each connected between the first and third nodes 51 and 53, and a coil 37 connected between the first and second nodes 51 and 52. The second variable reactance circuit consists of a coupling capacitor 39 connected between the output terminal 32 and a fourth node 54, a DC cutoff capacitor 40 connected between the fourth node 54, and a fifth node 55, another coil 41 connected between the first and fifth nodes 51 and 55 and another varactor diode 42 connected between the first and fourth nodes 51 and 54.

Resistors 43 and 44 each connected to ground, respectively apply a bias voltage to the varactor diodes 36 and 42 through a resistor 45. The resistors 43, 44 and 45 in FIG. 8 may be equal to or above 100 kilo-ohms.

In this embodiment, in order to set the impedance viewed from the transmission cable 16 to be 75 ohms, the saw-toothed voltage sweep having the voltage range corresponding to the predetermined FM frequency band is applied to cathodes of the varactor diodes 38 and 42 as well as to the inner varactor diode in the FM receiver. When an appropriate FM channel at a given frequency is selected by the FM receiver, the appropriate voltage is applied to the matching circuit to match the FM antenna with the FM receiver through the transmission cable at the given frequency. Reactance component of the antenna at the given frequency is therefore cancelled by controlled capacitance of the varactor diodes.

For example, the resistors 43, 44 and 45 may have 100 kilo-ohms. The capacitors 34 and 39 may have 5 to 50 picofarads, preferably 6 picofarads while the DC cutoff capacitors 35 and 40 may have 1 to 500 nano-farads, preferably 100 nano-farads. The capacitor 33 may have 5 to 50 picofarads, preferably 10 picofarads, while the capacitor 36 may have 0 to 50 picofarads, preferably 2 picofarads. The coils 37 and 41 may have 100 to 300 nanohenries, preferably 200 nanohenries.

Figure 9:
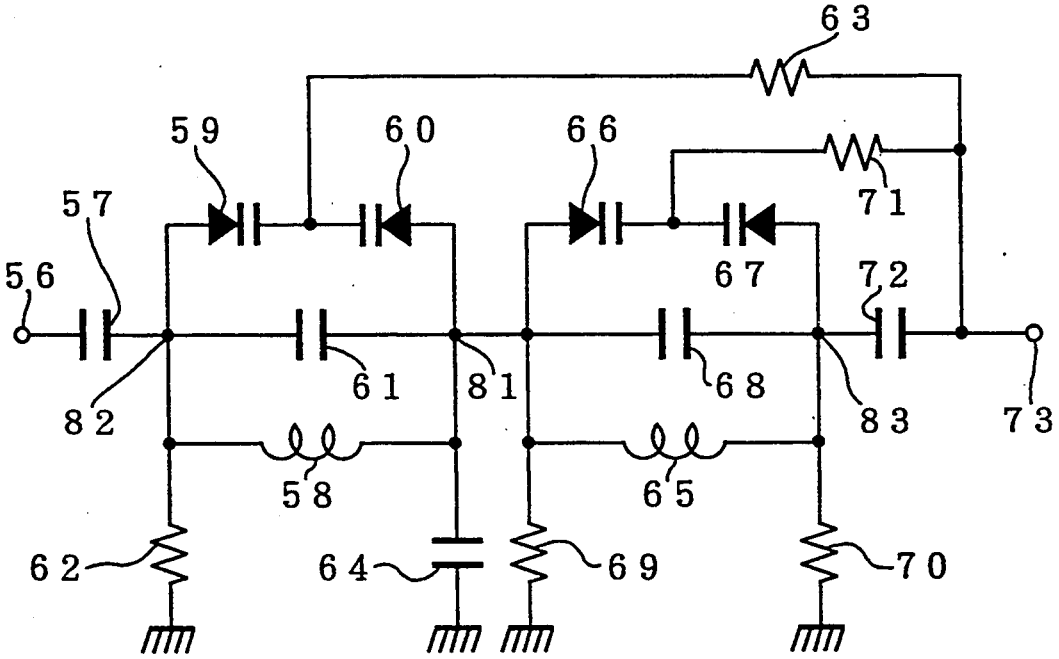
FIG. 9 is a circuit diagram showing another embodiment of the dynamic impedance matching circuit.

FIG. 9 shows another embodiment of the T-type dynamic matching circuit 13. An input terminal 56 is connected to the glass antenna 3 and 4 while an output terminal 73 is connected to the transmission cable 16 and 27 as shown respectively in FIGS. 4 and 6. The matching circuit 13 comprises a central capacitor 64 connected between a first node 81 and ground, and first and second variable reactance circuits as left and right branch configurations. The first variable reactance circuit comprises a coupling capacitor 57 connected between the input terminal 56 and a second node 82. A coil 58 and a capacitor 61 are connected between the first and second nodes 81 and 82. Anodes of common cathode varactor diodes 59 and 60 are connected to the second and first nodes 82 and 81 respectively. The common cathode of the varactor diodes 59 and 60 is connected to the output terminal 73 through a resistor 63.

The second variable reactance circuit comprises a coupling capacitor 72 connected between the output terminal 73 and a third node 83. Another coil 65 and a capacitor 68 are connected between the first and third nodes 81 and 83. Anodes of common cathode varactor diodes 66 and 67 are connected to the first and third nodes 81 and 83 respectively. The common cathode of the varactor diodes 66 and 67 is connected to the output terminal 73 through a resistor 71.

Resistors 69, 62 and 70 each connected to ground are also connected respectively to the first, second and third nodes 81, 82 and 83 to apply a bias voltage to the varactor diodes 59, 50, 66 and 67 through the resistors 63 and 71.

In this embodiment, to set the impedance viewed from the cable 16 to be 75, ohms, the saw-toothed voltage sweep is applied to the common cathodes of the varactor diodes 59, 60, 66 and 67 as well as to the inner varactor diode in the FM receiver. The sweep has the voltage range corresponding to the predetermined FM frequency band. When an appropriate FM channel at a given frequency is selected by the FM receiver, the appropriate voltage is applied to the matching circuit to match the FM antenna with the FM receiver through the transmission cable at the given frequency. Reactance component of the antenna at the given frequency is therefore cancelled with controlled capacitance of the varactor diodes.

For example, the resistors 62, 63, 69, 70 and 71 may have 100 kilo-ohms or more. The capacitor 57 may have 5 to 50 picofarads, preferably 30 picofarads while the capacitor 72 may have 5 to 50 picofarads, preferably 10 picofarads. The capacitor 64 may have 5 to 50 picofarads, preferably 10 picofarads while the capacitors 61 and 68 may have 0 to 50 picofarads, preferably 2 picofarads. The coils 58 and 65 may have 100 to 300 nanohenry, preferably 200 nanohenry.

As described above, the present glass antenna for the automobile of the invention has an advantage to enhance a tracking characteristic of the dynamic impedance matching circuit with respect to the reverse T-shaped main antenna which is provided on the upper blank portion of the defogging heaters so as to improve a gain for the main antenna system. The length and distance of its horizontal portion are predetermined to have monotonic changes with respect to the resistance and reactance components of its impedance as a function of the frequency within the FM frequency band. When the defogging heaters are used for the FM subsidiary antenna, the gain of the FM subsidiary antenna system and the tracking characteristic of the dynamic impedance matching circuit are also improved. This is because the antenna open voltage at the feeding point on the upper point of the bus is increased. Another reason is that its impedance versus frequency relation is simplified and becomes monotonic within the FM frequency is band. Lastly, the total gain of the entire direction is further improved when the main and subsidiary antennas are connected to a diversity system due to the main and subsidiary antennas disposed on the rear glass and having intersecting directivity.

What is claimed is:

1. A glass antenna for an automobile comprising:

an FM main antenna provided on a window glass of said automobile and having a reverse T-configuration;

an FM subsidiary and AM antenna provided on said window glass and consisting of defogging heaters;

a bus provided on said window glass and connected to said defogging heaters for supplying a defogging current;

a choke coil having a high impedance against AM frequencies;

a coil mounted on said window glass adjacent to said bus, having one end directly connected to said bus to prevent an FM signal from leaking, another end connected to said choke coil, said bus connected to said one end providing an output to FM frequencies; and a land provided on said window glass for receiving said defogging current through said choke coil, and said coil being a wireless lead component connected between said bus and said land.

2. A glass antenna according to claim 1, wherein said FM main antenna comprises a horizontal line arranged parallel to the uppermost heater of said heaters and having a predetermined distance thereto.

3. A glass antenna according to claim 2, wherein said horizontal line has a length of 500 millimeters and said predetermined distance is 10 millimeters.

4. A glass antenna according to claim 1, further comprising a lateral T pattern arranged parallel to said bus, wherein said bus is connected to said FM subsidiary and AM antenna, and said lateral T pattern and said bus form a coupling capacitor.

5. A glass antenna according to claim 1, wherein said coil has an inductance of 0.5 to 2.5 microhenry.

6. A glass antenna for an automobile comprising:

a first antenna provided on a window glass of said automobile and having a reverse T-configuration;

a second antenna provided on said window glass and consisting of defogging heaters;

a bus provided on said window glass and connected to said defogging heaters to be supplied with the defogging current;

a coil directly connected to said bus to prevent an FM signal from leaking; and a lateral T pattern arranged parallel to said bus, said bus being connected to said second antenna to provide a coupling capacitor in combination with said lateral T pattern, and said lateral T pattern having a length of 250 millimeters and including a center line having 10 millimeters in length.

* * * * *